US005384198A

United States Patent [19]

Hodges

[11] Patent Number: 5,384,198

[45] Date of Patent: Jan. 24, 1995

[54] WALL SHELF BRACKET

[76] Inventor: Charles E. Hodges, 6648 Golfclub Dr., Diamondhead, Miss. 39525

[21] Appl. No.: 118,582

[22] Filed: Sep. 10, 1993

[51] Int. Cl.[6] ..... A47G 1/16

[52] U.S. Cl. ..... 248/466; 248/475.1; 248/235; 248/250

[58] Field of Search ..... 248/466, 475.1, 488, 248/235, 250

[56] References Cited

U.S. PATENT DOCUMENTS

| | | | |
|---|---|---|---|
| D. 167,517 | 8/1952 | Kopko . | |
| D. 268,238 | 3/1983 | Brescia et al. . | |
| 993,753 | 5/1911 | Casper . | |
| 1,569,459 | 1/1926 | Colbert et al. | 248/475.1 |
| 3,363,341 | 1/1968 | Glassman . | |
| 4,049,226 | 9/1977 | Harvey . | |
| 4,177,901 | 12/1979 | Deconinck | 248/475.1 X |
| 4,691,887 | 9/1987 | Bessinger . | |
| 4,799,643 | 1/1989 | Shepard | 248/250 X |
| 4,915,338 | 4/1990 | Guth . | |
| 5,241,715 | 9/1993 | Duvall et al. | 4/605 |

FOREIGN PATENT DOCUMENTS

| | | | |
|---|---|---|---|
| 713438 | 7/1965 | Canada | 248/475.1 |
| 442787 | 4/1927 | Germany | 248/250 |
| 77981 | 1/1951 | Norway | 248/475.1 |
| 635323 | 4/1950 | United Kingdom | 248/475.1 |
| 2245829 | 1/1992 | United Kingdom | 248/466 |
| 1340744 | 9/1987 | U.S.S.R. | 248/235 |

*Primary Examiner*—Ramon O. Ramirez
*Assistant Examiner*—Derek J. Berger
*Attorney, Agent, or Firm*—Richard C. Litman

[57] ABSTRACT

A bracket for supporting a laboratory mirror and shelf is disclosed. The bracket is preferably an extrusion of aluminum or other rigid material and includes a pair of horizontally disposed guides or arms forming a channel for the receipt of a planar shelf. Additionally, a vertically disposed stop is provided for retaining a mirror in a vertical orientation against a supporting shoulder. In use, the bracket allows for the convenient installation of a shelf beneath a mirror such as would be found in a bathroom.

18 Claims, 1 Drawing Sheet

WALL SHELF BRACKET

BACKGROUND OF THE INVENTION

1. Field of the Invention

The present invention relates to a wall mount shelf support bracket and a method of installing the same, and, more particularly, to a surface mount bracket for providing vertical support for a wall mount vanity mirror as well as horizontal support for a shelf.

2. Description of the Prior Art

Cantilevered wall shelf brackets for supporting shelf panels have been known for many years. Wall shelves supported by cantilevered brackets are a fitting substitute for more expensive and space consuming shelving units. Earlier versions of cantilevered supports typically include a peg board arrangement or vertical wall standard and a plurality of cooperatively engageable brackets for fully supporting the shelf. There is an obvious utilitarian value associated with cantilevered shelf brackets, but the shelving brackets are not aesthetically appealing and therefore are often a poor substitute for use in the living areas of a home.

Attempts have been made in improving the appearance of cantilevered shelving brackets. The ornamental wall shelves most commonly used today employ screws for attaching the bracket to the wall. The screws are generally concealed by the shelves or a removably attachable facing. Although fasteners are concealed in some way or another, the overall appearance of the bracket generally remains quite unappealing.

What is needed is a wall shelf system which provides a shelf bracket for use in permanently and securely supporting a shelf. The wall shelf bracket should be simple in design and amenable to fabrication by simple die extrusion process. Moreover, the wall shelf bracket should be capable of receiving a shelf and frictionally engaging the same through a wedging action. This wedging action is accomplished through the cooperative engagement between the shelf panel and the shelf bracket. A shelf panel having a thickness of close tolerance to the support bracket is placed under a slightly deforming wedging stress during intersection with the supporting bracket, for secure retention of the shelf panel. The supporting bracket should be aesthetically appealing. U.S. Pat. No. 4,691,887, issued Sep. 8, 1987 to Walter L. Bessinger, and U.S. Pat. No. 4,195,338, issued Apr. 10, 1990 to David C. Guth, each show surface mountable shelf supports for frictionally receiving a shelf.

In addition to supporting a shelf, applicant's instant invention is configured to support a mirror and to enable the silver backing on the bottom edge to be sealed. The support bracket according to applicant's instant invention is ideal for use in bathrooms, and for supporting both a shelf and a mirror. Condensation created in a bathroom forms on the bathroom mirror and frequently drains from the surface of the mirror and collects along the bottom edge thereof. Over a period of time, this can cause the silver along the bottom edge to deteriorate. Setting the bottom edge of the mirror in a sealant may inhibit the deterioration of the silver. Spray sealants are available; however, immersing the bottom edge in a sealant may be more effective.

It is well known to provide a means to support both a mirror and a shelf. For example, U.S. Pat. No. 993,753, issued May 30, 1911 to Charles J. Casper, and U.S. Pat. Des. No. 167,517, issued Aug. 19, 1952 to John E. Kopko, and U.S. Pat. No. 268,238, issued Mar. 15, 1983 to Anthony J. Brescia et al., all disclose mirror and shelf units. Further, similar to the mirror and shelf supports, U.S. Pat. No. 3,363,341, issued Jan. 16, 1968 to Frederick R. Glassman, discloses a blackboard having an integral shelf. Yet another patent which is deemed of interest in U.S. Pat. No. 4,049,226, issued Sep. 20, 1977 to Louis A. Harvey, disclosing a bracket for supporting both a vertical and horizontal panel. However, none of these patents describes a means for supporting and sealing the bottom edge of the mirror to protect the silver backing of the mirror against deterioration. None of the above inventions and patents, taken either singly or in combination, is seen to describe the instant invention as claimed.

SUMMARY OF THE INVENTION

The present invention is related to a support for supporting a shelf. The support is to be an extrusion of aluminum or other rigid material, in its preferred form, and includes a pair of horizontally disposed guides or arms forming a channel for receipt of a planar shelf. Additionally, a vertically disposed stop is provided for retaining a mirror in a vertical orientation against a supporting surface. In use, the bracket allows for the convenient installation of a shelf beneath a mirror such as would be found in a bathroom.

Accordingly, it is a principal object of the invention to provide a support for providing horizontal support for a shelf and vertical support for a lavatory mirror.

It is another object that the support be aesthetically appealing and that fasteners for securing the same to a mounting surface be concealed from view.

It is a further object that the support be expediently mountable and that the integrity of the mounting of the support of over the length of the shelf be consistent.

Still another object is that the support be configured to support the shelf in a manner such that any wobbling of the shelf supported thereby is essentially eliminated.

It is yet another object that the mirror sealingly engage the support so as to simultaneously seal the bottom edge of the mirror against moisture and condensation build up.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
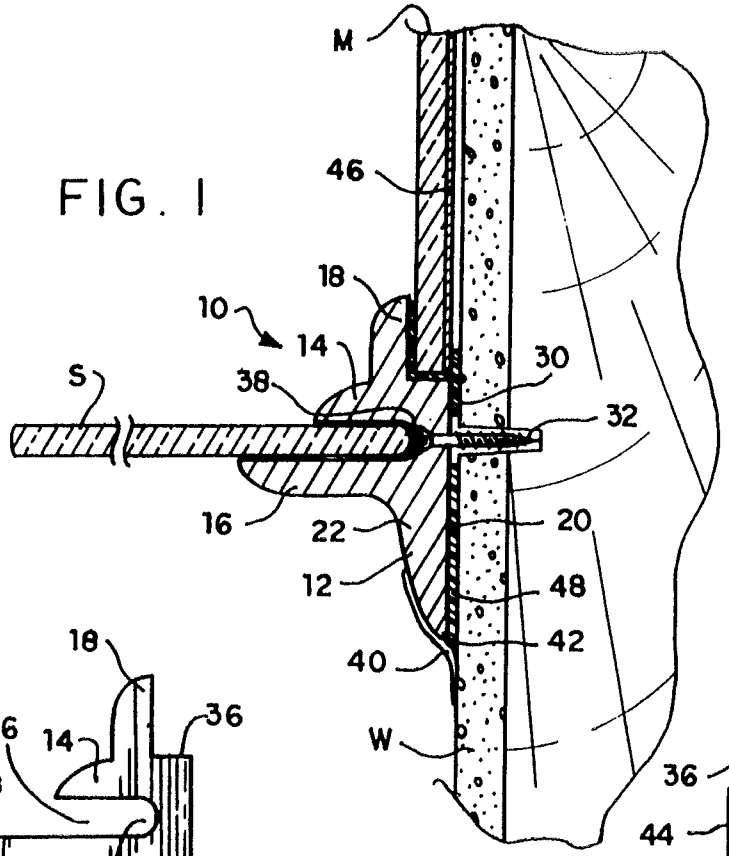
FIG. 1 is an environmental cross sectional view of shelf support according the present invention.
Figure 2:
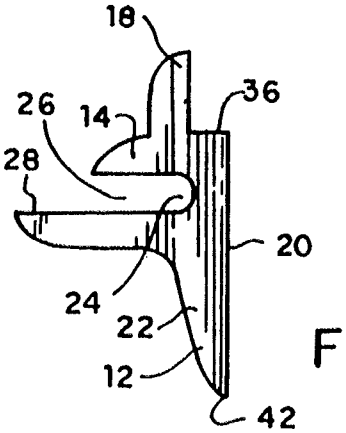
FIG. 2 is a side elevational view of the shelf support shown in FIG. 1.

The present invention, as shown in FIGS. 1 and 2, is a wall mount shelf support 10, including a vertical mounting plate or bracket 12, upper and lower forwardly extending projections or guides 14, 16, and an upwardly extending stop 18.

The bracket 12 includes a substantially planar rear wall or a mounting surface 20 for placing shelf support 10 adjacent a wall or surface W on which the support 10 is to be mounted. The bracket 12 further includes a front wall 22 from which extend the upper and lower guides 14, 16.

The upper and lower guides 14, 16 are spaced apart to provide a channel 24 therebetween and a throat 26 providing access to the channel 24. The channel 24 is preferably dimensioned to receive a shelf S fabricated of tempered glass or plastic material having a standard thickness of 6 mm. A close tolerance exists between the guides 14, 16 and the shelf S. The upper surface 28 of the lower guide 16 is a platform for supporting a shelf S. A hole 30 is located to the rear of the channel 24 to permit the passage of a threaded fastener 32 for securing the support 10 to the wall W.

The stop 18 extends upwardly from the upper surface of the upper guide 14. The stop 18 is disposed medially of the upper guide 14 so as to form a notch or shoulder 36 to the rear of the stop 18. The shoulder 36 is configured to provide vertical support for a mirror M.

Figure 3:
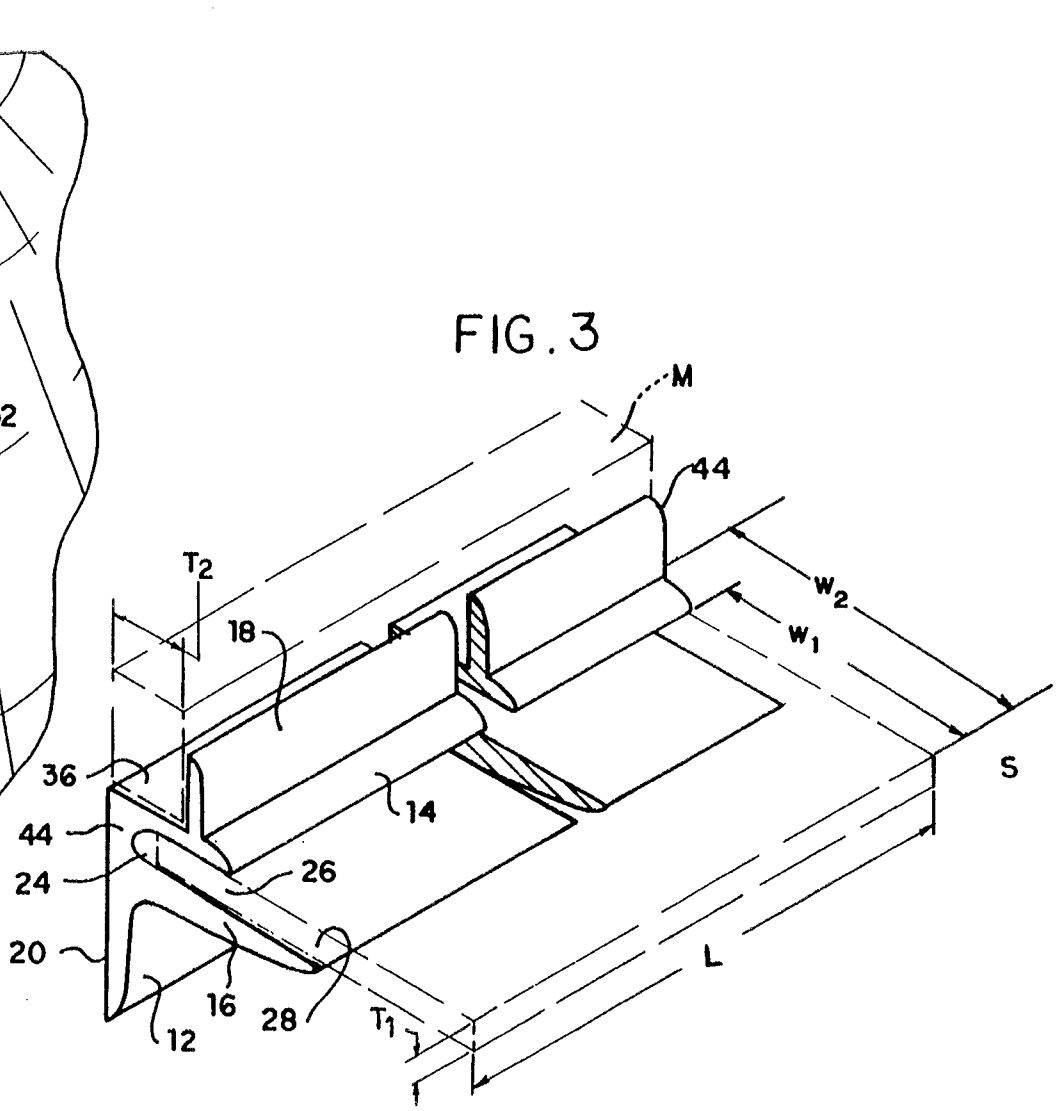
FIG. 3 is a perspective view of the shelf support showing a shelf panel and a mirror supported thereby in phantom lines.

The support 10 is preferably aluminum alloy extrusion. As shown in FIG. 3, the mirror M preferably has the standard thickness $T_2$ of 6 mm. Likewise, the shoulder 36 has a width of approximately 6 mm so that the mirror M is snugly received between the stop 18 and the wall W. The support 10 has an overall length L equivalent to that of a conventional mirror M. Conventional mirrors M range in length from 100 cm to 240 cm. The shelf S is configured to have a narrow width $W_2$ for two reasons. First, as stated above, a survey of the items typically supported by the shelf S indicates that the surface width required for supporting such items is 9 cm or less. The shelf S is preferably 10.5 cm wide to provide sufficient support for most common bathroom articles (not shown). Secondly, the shelf is narrow to maintain the minimum seven inches (18 cm) of clearance required above the lavatory faucet handles (not shown) for convenient access and line of sight for the same. The length L of the shelf S relative to its narrow width $W_2$, and the friction produced between the shelf S and the guides 14, 16 retaining the same, substantially eliminate any play or wobble in the shelf S.

Referring to FIG. 1, the support 10 is shown mounted to a wall W through the use of the threaded fastener 32 shown. Sealant 38 is deposited between the guides 14, 16 and along the back vertical edge of the shelf S. The standard thicknesses $T_1$ of many available manufactured glass, acrylic, and polycarbonate sheets are so similar that shelves S of these materials can be inserted fairly tightly between these guides 14, 16, and are held substantially securely in place, even without the application of the sealant 38. The sealant 38 is preferably a heavy paste-like consistency and is applied intermittently along the rear of the guides 14, 16 to insure that the shelf S is likely to withstand vertically impinging forces. Though the shelf S is resistant to vertical displacement, the same may be horizontally displaced and removed from the channel 24 through the use of a leverage device, such as a screw driver (not shown), wedged between the extrusion and the rear vertical edge of the shelf S. Again, with reference to FIG. 3, and in the preferred embodiment, shelf S has an overall width of 10.5 cm, as is indicated at $W_2$, and an effective surface support width of 9 cm, as is indicated at $W_1$, this being the distance between the very front edge of guide 14 and the outer edge of shelf S.

A self-leveling mirror sealant 48 is used to solve two problems. First, the sealant 48 seals the bottom edge of the mirror M, and second, the sealant 48 fills any void between the rear wall 20 of the bracket 12 and any irregularity in the wall W on which the support 10 is mounted. To prevent the sealant 48 from running, tape 40, such as the masking tape shown, is applied about the bottom edge 42 and side edges 44 (shown in FIG. 3) of the bracket 12. Once the sealant 48 has set up, the tape is removed. The sealant 48 ensures that a sufficient seal is provided to protect the mirror to reduce the risk of deterioration of the silver 46, and also improves the integrity of the installation of the support 10.

This support 10 can be mounted to numerous surfaces. The method will vary in accordance with the surface to which the surface 10 is to be attached. The fasteners required might be wood screws 32 tap-in nylon expansion anchors, or hollow wall screw anchors, to name a few, and depending on the composition of the mounting surface W.

It is to be understood that the present invention is not limited to the sole embodiment described above, but encompasses any and all embodiments within the scope of the following claims.

I claim:

1. A wall shelf support comprising:

a vertical plate having a front surface and a rear mounting surface;

upper and lower horizontal projections extending forwardly from said front surface of said plate, said upper and lower horizontal projections forming a channel therebetween, each of said upper and lower projections including an upper surface;

a vertical projection extending upwardly from said upper surface of said upper horizontal projection; and a shoulder being formed atop said plate and extending rearwardly from said vertical projection to said rear mounting surface of said vertical plate; said shelf support is of monolithic construction, whereby said channel is dimensioned and configured to support a generally horizontally disposed shelf therebetween, said shoulder and said vertical projection are dimensioned and configured to entrap and support a generally vertically disposed mirror therewithin and against a wall surface upon which said shelf support is installed.

2. The wall shelf support according to claim 1, further including means for defining at least one hole through said plate, and wherein said channel communicates with said hole, for insertion therethrough of means for anchoring said wall shelf support to a wall upon which said shelf unit is installed.

3. The wall shelf support according to claim 2, wherein said shelf support is fabricated of aluminum.

4. The wall shelf support according to claim 3, wherein each of said upper and lower horizontal projections has predetermined length and width dimensions, the width of said lower horizontal projection being substantially greater than the width of said upper horizontal projection.

5. The wall shelf support according to claim 1, wherein both said upper and lower horizontal projections each have predetermined length and width dimensions, the width of said lower horizontal projection being substantially greater than said upper horizontal projection.

6. The wall shelf support according to claim 5, further comprising means for defining at least one hole through said plate, wherein said channel communicates with said hole, for insertion therethrough of means for anchoring said wall shelf support to a supporting surface.

7. The wall shelf support according to claim 6, further comprising sealant means located behind said vertically disposed plate for providing a seal between said shelf support and a supporting surface.

8. The wall shelf support according to claim 7, wherein said shelf support is fabricated of aluminum.

9. The wall shelf support according to claim 1, there further being sealant means located behind said vertically disposed plate.

10. The wall shelf support according to claim 1, wherein said shelf support is fabricated of aluminum.

11. A mirror and shelf support for use with a mirror and a shelf comprising:

a vertical plate having at least a shoulder;

upper and lower horizontal projections extending from said plate, said upper and lower horizontal projections defining a shelf-receiving channel therebetween;

a vertical mirror stop extending from said shoulder of said plate; said mirror stop and said shoulder defining an L-shaped engaging member, said L-shaped engaging member cooperating with a supporting surface to define a mirror receiving aperture configured so said mirror and shelf support is adapted to carry and support the mirror directly against the supporting surface; said mirror and shelf support defining a monolithic construction.

12. The wall shelf support according to claim 11, wherein each of said upper and lower horizontal projections has predetermined length and width dimensions, the width of said lower horizontal projection being substantially greater than the width of said upper horizontal projection.

13. The wall shelf support according to claim 12, further comprising means for defining at least one hole through said plate, wherein said channel communicates with said hole, for insertion therethrough of means for anchoring said wall shelf support to a supporting surface.

14. The wall shelf support according to claim 13, further comprising sealant means located behind said vertically disposed plate for providing a seal between said shelf support and a supporting surface.

15. The wall shelf support according to claim 14, wherein said shelf support is fabricated of aluminum.

16. A support for use with a mirror and a shelf comprising:

a vertical plate having a front surface and a rear mounting surface;

upper and lower horizontal projections extending forwardly from said front surface of said plate, said upper and lower horizontal projections forming a channel therebetween for receiving a shelf, each of said upper and lower projections including an upper surface;

a vertical projection extending upwardly from said upper surface of said upper horizontal projection; and a shoulder being formed atop said plate and extending rearwardly from said vertical projection to said rear mounting surface of said vertical plate; said vertical projection and said shoulder defining an L-shaped engaging member, said L-shaped engaging member cooperating with a supporting surface to define a mirror receiving aperture for supporting a mirror directly against the supporting surface; said support having a monolithic construction.

17. The support according to claim 16, wherein each of said upper and lower horizontal projections has predetermined length and width dimensions, the width of said lower horizontal projection being substantially greater than the width of said upper horizontal projection.

18. The support according to claim 16, wherein said support is fabricated of aluminum.

* * * * *

UNITED STATES PATENT AND TRADEMARK OFFICE

CERTIFICATE OF CORRECTION

PATENT NO. : 5,384,198

DATED : January 24, 1995

INVENTOR(S) : Charles E. Hodges

It is certified that error appears in the above-indentified patent and that said Letters Patent is hereby corrected as shown below:

Title page, item [57], col. 2,
Line 1 of the Abstract should read "A bracket for supporting a lavatory mirror and shelf".

Signed and Sealed this

Twenty-eight Day of March, 1995

*Attest:*

Bruce Lehman

BRUCE LEHMAN

*Attesting Officer*

*Commissioner of Patents and Trademarks*